US006102519A

United States Patent [19]

Yasui et al.

[11] Patent Number: 6,102,519

[45] Date of Patent: Aug. 15, 2000

[54] RECORDING HEAD POSITION DETECTING DEVICE

[75] Inventors: Tsuneo Yasui; Hakudai Kondo, both of Nagoya; Akira Sago, Seto; Kazuhiko Matsuda, Kounan; Masashi Suzuki, Nagoya, all of Japan

[73] Assignee: Brother Kogyo Kabushiki Kaisha, Nagoya, Japan

[21] Appl. No.: 09/023,112

[22] Filed: Feb. 13, 1998

[30] Foreign Application Priority Data

Feb. 14, 1997 [JP] Japan ..... 9-030909
Feb. 14, 1997 [JP] Japan ..... 9-030910

[51] Int. Cl.[7] ..... B41J 23/00

[52] U.S. Cl. ..... 347/37; 347/88

[58] Field of Search ..... 347/37, 88; 400/139, 400/705, 705.1

[56] References Cited

U.S. PATENT DOCUMENTS 4,601,595 7/1986 Aiba et al. ..... 400/637
5,331,680 7/1994 Ueno ..... 377/17
5,368,402 11/1994 Takahashi et al. ..... 400/279
5,748,206 5/1998 Yamane ..... 347/37
5,781,210 7/1998 Hirano et al. ..... 347/51

FOREIGN PATENT DOCUMENTS 0 178 888 4/1986 European Pat. Off. ..... 347/88
0209895 11/1984 Japan ..... 400/705.1

*Primary Examiner*—N. Le
*Assistant Examiner*—Shih-wen Hsieh
*Attorney, Agent, or Firm*—Oliff & Berridge, PLC

[57] ABSTRACT

In the position detection device, a timing fence is formed with a plurality of slits which are arranged in its elongated direction. An elongated metal member is provided for supporting the timing fence so that the timing fences will extend in the scanning direction of the image recording head. An encoder is provided for counting the slits on the timing fence while the carriage moves. A gap between the encoder and the elongated metal member can be adjusted properly and uniformly through rotating eccentric collars of the adjustment members inserted into the elongated through-holes in the elongated metal member.

36 Claims, 12 Drawing Sheets

RECORDING HEAD POSITION DETECTING DEVICE

BACKGROUND OF THE INVENTION

1. Field of the Invention

The present invention relates to a position detecting device for detecting position of an image recording head.

2. Description of the Related Art

There is conventionally known an image forming device for recording characters and patterns onto a large sized image recording medium such as an A0 sized paper. This type of image forming device is generally constructed so that an image recording head ejects ink onto the image recording medium while scanningly moving relative to the image recording medium. In order to determine a timing to eject ink, the position of the scanning image recording head is detected with the use of a position detecting device.

SUMMARY OF THE INVENTION

FIG. 1 shows an internal structure of a conceivable image forming device which is capable of recording images on a recording medium having a large size, such as an A0-sized paper, while freely setting the length of a recording area to various lengths. As shown in FIG. 1, an image recording head 7 is mounted on a carriage 10, and is scanningly moved parallel to a platen 2 by a carriage driving device (not shown). A position detection device for detecting the position of the image recording head 7 is constructed from an elongated timing fence (slit member) 15 and an encoder 20. The timing fence 15 is a long strip-shaped member formed with a plurality of slits arranged in the head scanning direction. The encoder 20 is constructed from a light emitting unit for emitting light and a light receiving unit for receiving the light emitted from the light emitting unit. The encoder 20 is fixedly mounted to the carriage 10, while the timing fence 15 is fixed to the body of the image forming device. The encoder 20 is provided so that the light emitting unit and the light receiving unit sandwich the timing fence 15 therebetween. With this arrangement, the encoder 20 counts slits on the timing fence 15 when the carriage 10 scanningly moves along the timing fence 15. The encoder 20 can therefore detect the amount by which the 15 carriage 10 moves, that is, the present position of the carriage 10. While thus being scanningly moved, the image recording head 7 ejects ink from selected nozzles in accordance with signals issued from the encoder 20. An image recording medium P is conveyed on the platen 2 by a sheet feed mechanism constructed from several feed rollers. The image recording medium P is therefore recorded with a desired ink image.

Although not shown in the drawing, the elongated timing fence 15 is fixedly attached to the image forming device body (frame) via an elongated supporting member. More specifically, the elongated supporting member is attached to the frame of the image forming device. The timing fence 15 is attached to this elongated supporting member. Each of the timing fence 15 and the supporting member has a length as long as fifty inches or more, in order to be capable of recording large-sized papers such as A0-sized papers. Accordingly, the supporting member may possibly fail to sufficiently extend linearly over its entire length. The timing fence 15 will therefore be bent or curved along the surface of the supporting member. In this case, the distance between the timing fence 15 and the encoder 20 becomes non-uniform over the entire scanning area, in which the recording head 7 scanningly moves. As a result, light from the light emitting unit diffuses after passing through the timing fence.

The diffused light will not be properly received by the light receiving unit. The encoder 20 will not accurately count the slits, thereby performing an error detection. Accurate position detection can not be attained. Even when the supporting member sufficiently linearly extends over its entire length, if the supporting member is not accurately attached to the device body, the distance between the timing fence 15 and the encoder 20 will not still be uniform over the scanning moving area either. It is required to attach the supporting member to the device frame with high accuracy.

Especially when the image recording head 7 is of a type for recording images with a hot melt type ink (which is solid in room temperature, but melts when heated), the carriage 10 is provided with heaters 9 for heating the ink. The heat generated at the heaters 9 may possibly be transmitted to the encoder 20. Due to this heat, the timing fence 15 may possibly be thermally expanded or bent, whereby the intervals between the slits along the timing fence 15 may become nonuniform. When the encoder 20 is heated to a temperature higher than its rated temperature, the encoder 20 will become incapable of accurately counting the slits.

The present invention is therefore attained to solve the above-described problems. An object of the present invention is to provide an improved position detecting device, in which the distance between the encoder and the slit member can be easily adjusted even after the support member is attached to the device frame, and accordingly which is capable of accurately detecting position of the image recording head.

Another object of the present invention is to provide an improved position detecting device which is capable of accurately detecting position of the image recording head without being affected from any ink-melting heat even when the image recording head is of a type for recording images with hot melt type ink.

In order to attain the above and other objects, the present invention provides an image recording device for recording an image, the device comprising: a frame body; an image recording medium feed unit fixedly secured to the frame body for feeding an image recording medium in a recording medium feeding direction; a recording head capable of recording an image onto the image recording medium fed by the image recording medium feed unit; a carriage provided movable with respect to the frame body, the carriage mounting thereon the recording head and scanning the recording head in a scanning direction relative to the image recording medium fed by the image recording medium feed unit, the scanning direction being different from the recording medium feeding direction; a supporting member attached to the frame body and elongated in the scanning direction; an elongated slit member attached to the supporting member so that the slit member is elongated in the scanning direction, the slit member being formed with a plurality of slits arranged in the scanning direction; an encoder, mounted on the carriage, for counting the slits formed on the slit member while the carriage moves in the scanning direction; and an adjustment unit for adjusting a position, at which the supporting member is attached to the frame body, thereby adjusting an amount of a gap provided between the encoder and the slit member.

According to another aspect, the present invention provides an image recording device for recording an image on an image recording medium, the device comprising: an image recording medium feeding unit for feeding an image recording medium in a recording medium feeding direction; a alit member provided extending in a predetermined direction different from the recording medium feeding direction and formed with a plurality of slits arranged in the predetermined direction; and a carriage movable parallel to the slit member in the predetermined direction, the carriage mounting thereon an image recording head for ejecting ink onto the image recording medium, a heater for heating the ink, and an encoder for counting the slits on the slit member, the carriage including a heat transmission prevention member for preventing heat from being transmitted from the heater to the encoder.

According to a further aspect, the present invention provides a position detection device for detecting a position of an image recording head for recording an image on an image recording medium, the position detection device comprising: a frame body: an elongated supporting member attached to the frame body and elongated in a predetermined direction; a slit member supported by the elongated supporting member, the slit member being elongated In the predetermined direction and being formed with a plurality of slits arranged in the predetermined direction; an adjustment unit for adjusting the position, at which the supporting member is attached to the frame body; and an encoder, mounted on a carriage which mounts thereon an image recording head, for counting the plurality of slits formed on the slit member while the carriage moves in a direction parallel to the predetermined direction.

According to still another aspect, the present invention provides a position detection device for detecting a position of an image recording head for recording an image on an image recording medium, the position detection device comprising: an elongated slit member elongated in a predetermined direction and being formed with a plurality of slits arranged in the predetermined direction, a carriage provided movable relative to the elongated slit member in the predetermined direction, the carriage including: a head supporting portion for supporting thereon an ink ejection head for ejecting ink and a heater for heating the Ink to be ejected by the ink ejection head; an encoder supporting portion for supporting thereon an encoder for counting the plurality of slits formed on the slit member while the carriage moves in the predetermined direction; and a heat transmission prevention portion for preventing heat from being transmitted from the heater to the encoder.

BRIEF DESCRIPTION OF THE DRAWINGS

In the drawings:

FIG. 13(*b*) is an enlarged perspective view showing an essential part of the arm portion in FIG. 13(*a*).

DETAILED DESCRIPTION OF THE PREFERRED EMBODIMENTS

A position detecting device according to preferred embodiments of the present invention will be described while referring to the accompanying drawings.

Figure 1:
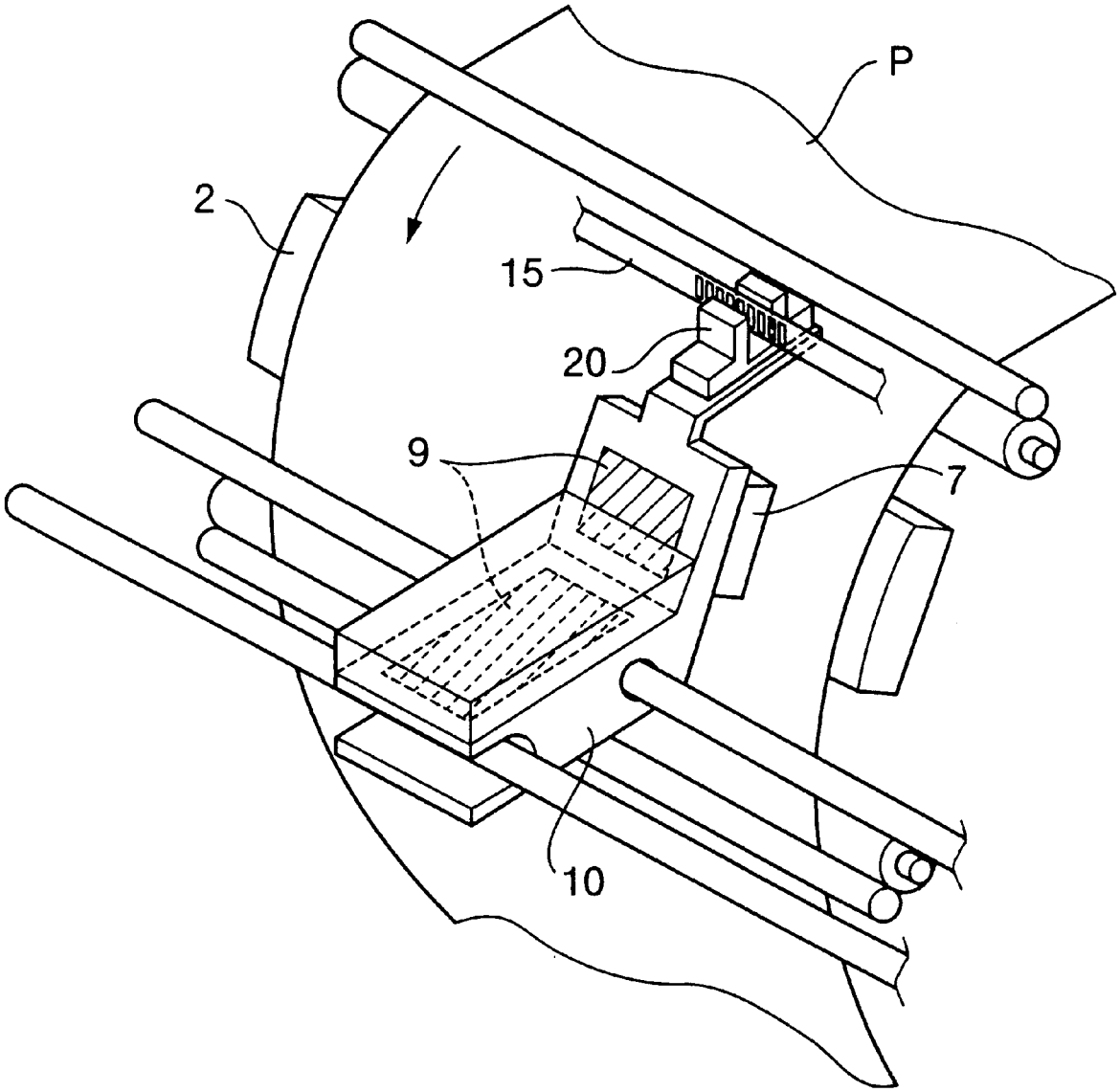
FIG. 1 is a perspective view of an image recording mechanism employed in an image forming device, in which a conceivable position detection device is provided for detecting position an image recording head.
Figure 2:
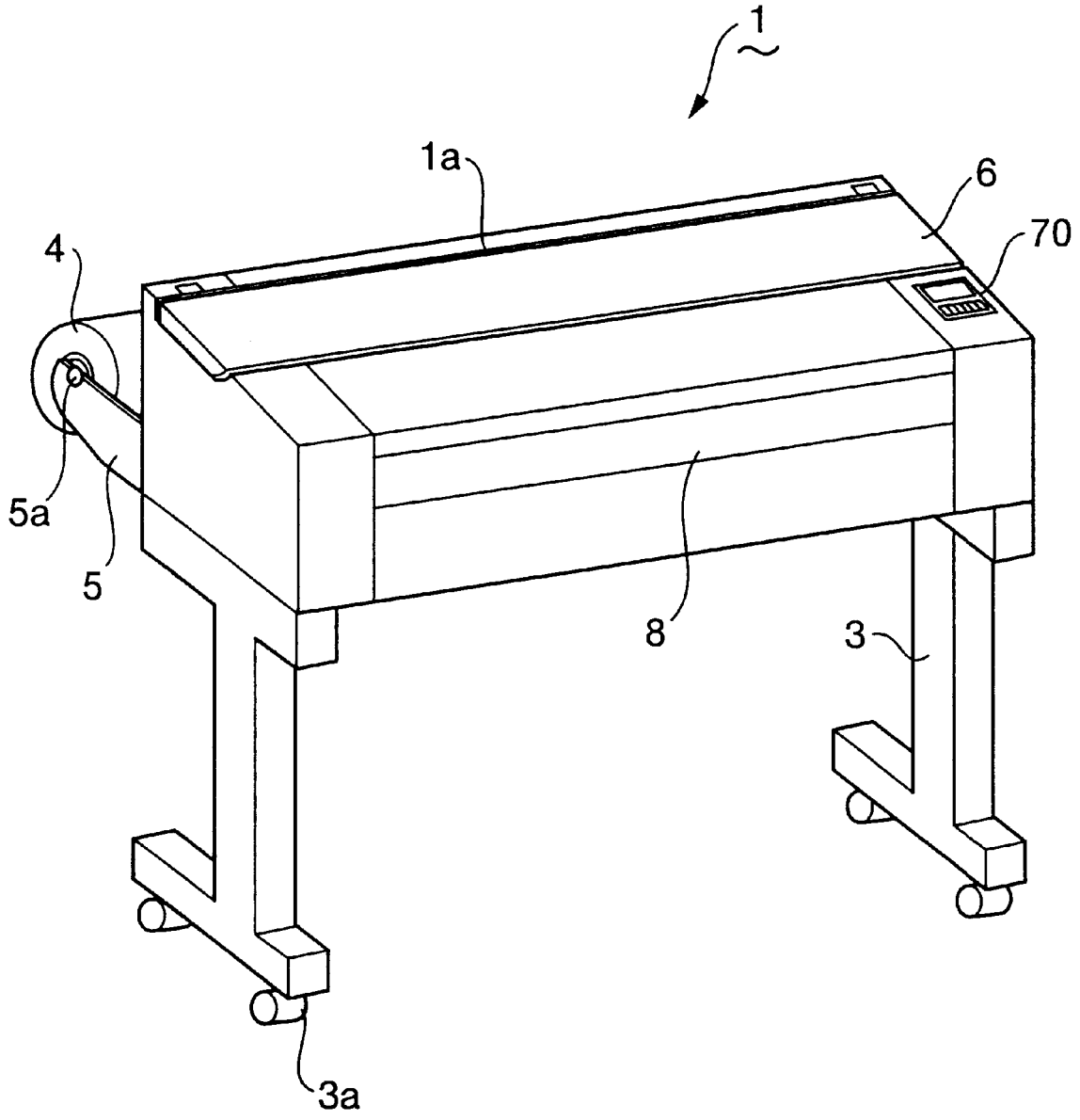
FIG. 2 is an external view of an image forming device, to which plied is a position detection device according to a first preferred embodiment of the present invention.

FIG. 2 is an external perspective view of an image forming device 1, in which a position detection device of a first embodiment of the present invention is provided for detecting an image recording head.

Directional terms, such as right, left, up, and down, will be used in the following description with reference to the state of the image forming device 1 located in an orientation as shown in FIG. 2.

The image forming device 1 is a large-scale printer capable of recording characters and images on a recording medium P having a large size, such as an A0-size paper, while freely setting a recording length to a desired amount. The image forming device 1 includes a main body la and legs 3 for supporting the main body 1*a* thereon. A roll support member 5 is provided on the back side portion of the main body 1*a*. The roll support member 5 is formed with depressions 5*a* for freely and rotatably supporting a recording paper roll 4 thereon. A desired length of a recording paper P (recording medium) is drawn from the recording paper roll 4 and is recorded with a desired image by an image recording mechanism installed within the image forming device 1.

A main cover 6 and an operation panel 70 are provided on the top of the main body 1*a*. When opening the main cover 6, a user can perform a maintenance operation onto the image recording mechanism installed in the main body 1*a*. The operation panel 70 in formed with several operational switches. An image recording medium delivery opening 8 is provided in the front surface of the main body 1*a* for delivering the freshly printed recording medium P. Casters 3*a* are installed on the bottom portions of the legs 3 to facilitate moving of the image forming device 1.

Figure 3:
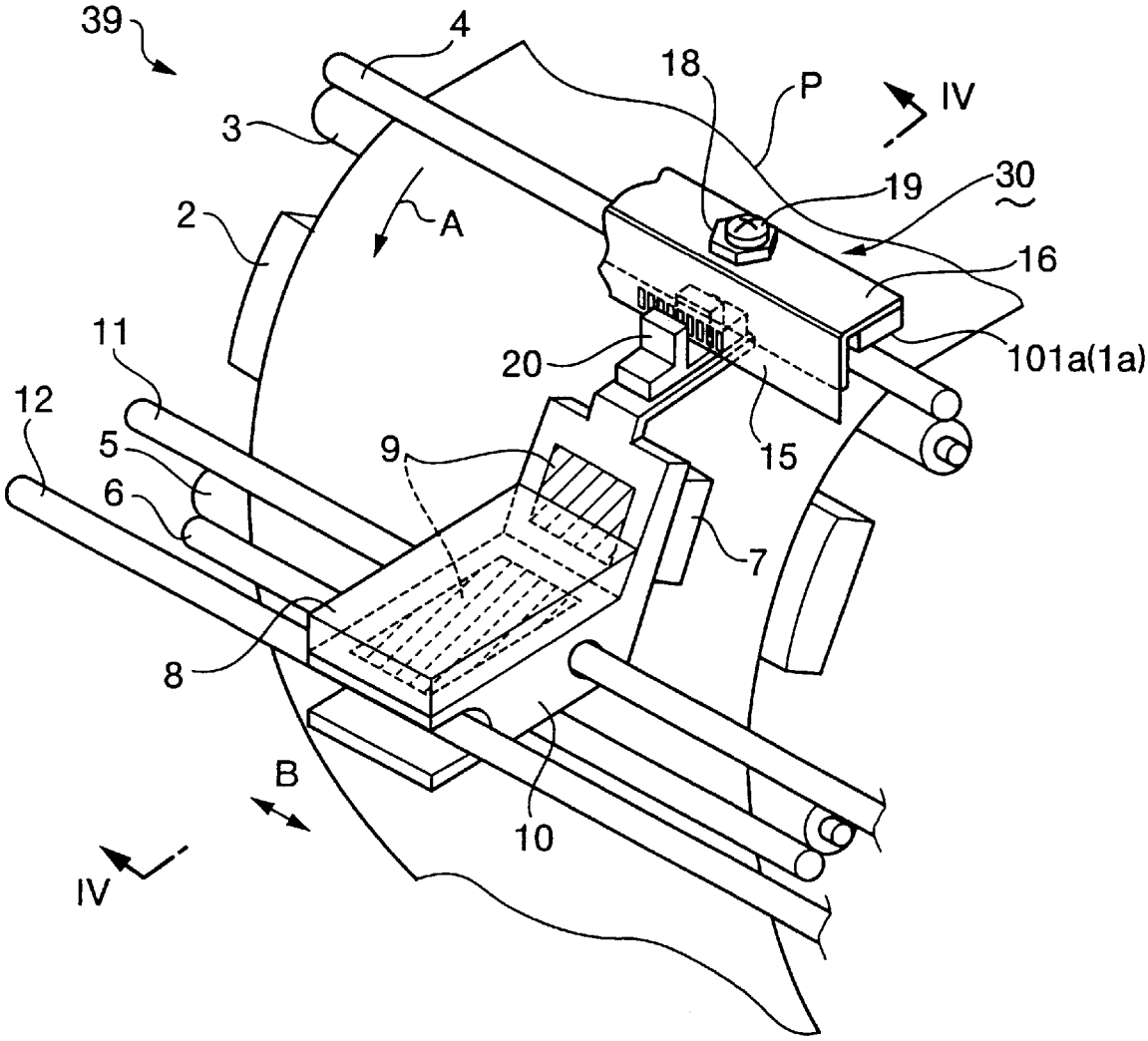
FIG. 3 is a perspective view of an image recording mechanism employed in the image forming device of FIG. 2. in which a position detection device of the first embodiment is provided.
Figure 4:
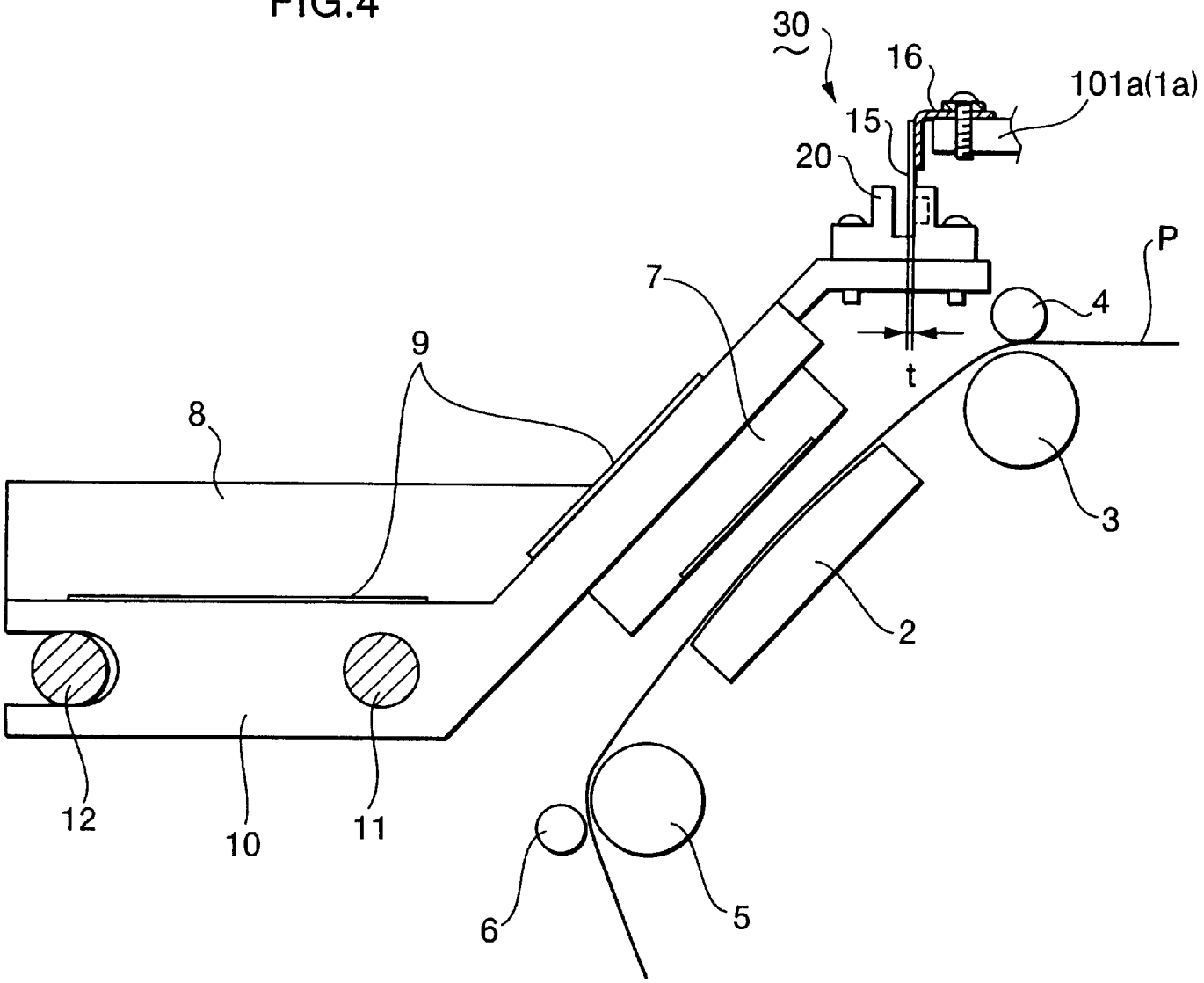
FIG. 4 is a cross-sectional side view of the image recording mechanism of FIG. 3 taken along a line IV—IV in FIG. 3.

FIG. 3 is a perspective view of an image recording mechanism installed within the image forming device 1. FIG. 4 is a cross-sectional side view of the image recording mechanism taken along a line IV—IV in FIG. 3.

A plate-shaped platen 2 is provided within the main body 1*a*. The platen 2 is for receiving the recording medium P drawn from the roll of paper 4. A main roller 3 and a pressure roller 4 are provided on the upstream side of the platen 2 to feed the paper P for printing. A delivery roller 5 and a pressure roller 6 are provided on the downstream side of the platen 2 to expel the paper P that has been printed. The recording medium P is held against the rollers 3 and 5 by the pressure rollers 4 and 6, respectively. Hence, a paper feed mechanism 39 is constructed from the rollers 3–6. The main roller 3 and the delivery roller 5 are rotated by a drive mechanism 40 (shown in FIG. 7), which includes a drive motor and a gear train (not shown). The rollers 3 and 5 cooperate to move the recording medium P by degrees in a direction A indicated in the drawing.

Two guide bars 11 and 12 are provided in parallel to each other and to the platen 2. The ends of the guide bars 11 and 12 are fixed in both side surfaces (not shown) of the main body 1*a* of the image forming device 1. A carriage 10 is freely supported on the guide bars 11 and 12 and can slide left and right along the same. The carriage 10 can therefore be scanningly moved in a scanning direction B which is almost perpendicular to the sheet feeding direction A. The recording head 7 is mounted on the carriage 10 at a position opposing the platen 2 via the paper P. The recording head 7 is of an ink-ejection type. An ink tank 8 and heaters 9 are also mounted on the carriage 10. More At specifically, the ink-ejection type recording head 7 is of a type for printing desired Images onto the recording medium P through ejecting melted hot melt Ink. The hot melt ink, which is in solid form at room temperature, has to be heated to reach a melted state. Accordingly, the heaters 9 are mounted on the recording head 7 and on the ink tank 8 in order to melt the hot melt ink into a liquid form.

A carriage drive mechanism 38 (shown in FIG. 7) is provided to drive the carriage 10 along the guide bars 11 and 12 in a scanning motion, left and right, across the recording medium P. Accordingly, the recording head 7, which to mounted on the carriage 10, can scan the recording medium P in its widthwise direction, thereby forming a desired ink image on the recording medium P.

A position detection device 30 for detecting the position of the recording head 7 is constructed mainly from an elongated strip-shaped timing fence (slit member) 15 attached to the frame 1*a* and an encoder 20 attached to the carriage 10.

Figure 5:
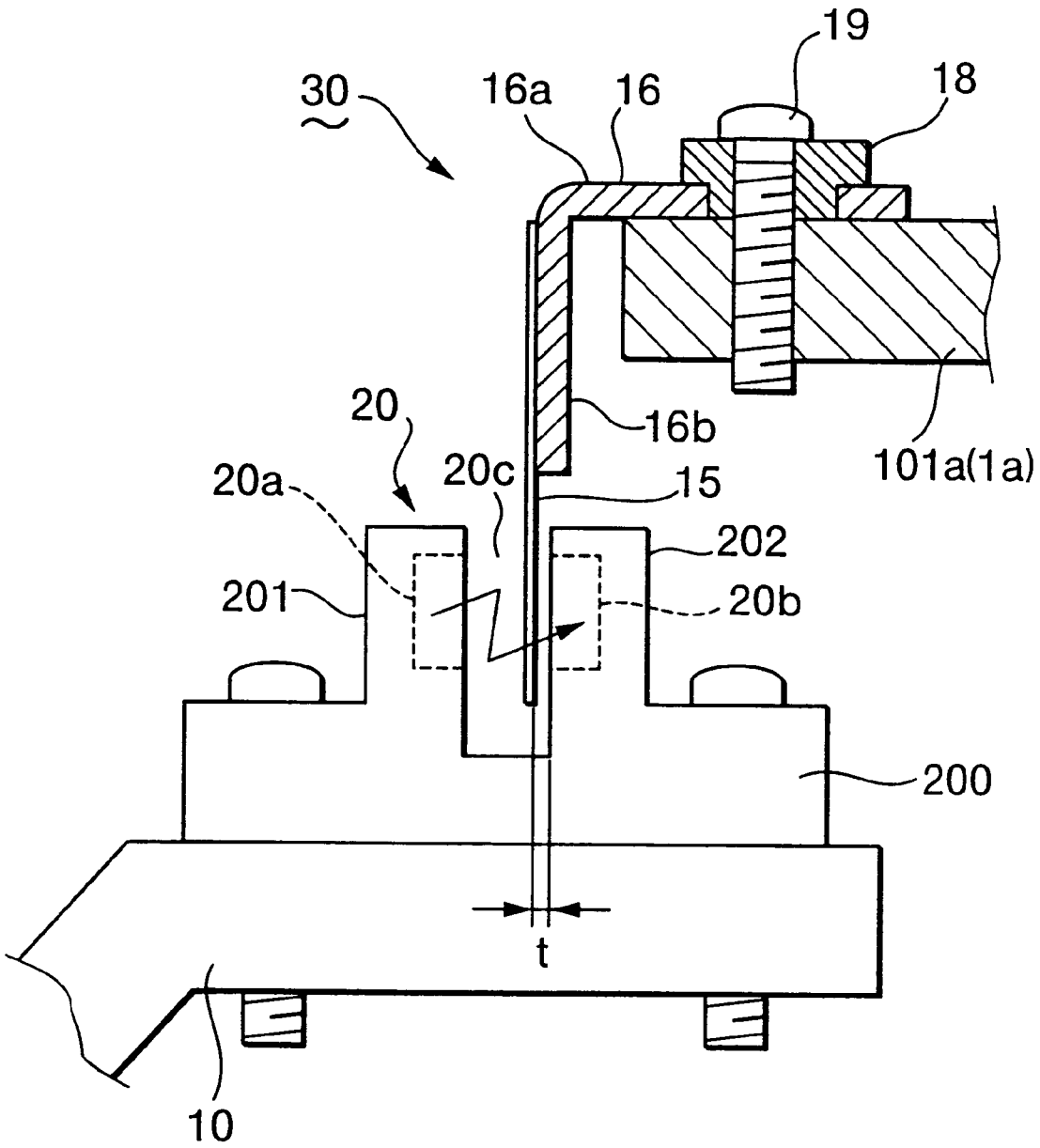
FIG. 5 is an enlarged cross-sectional side view of the image recording mechanism of FIG. 4, in which the position detection device is shown.
Figure 6:
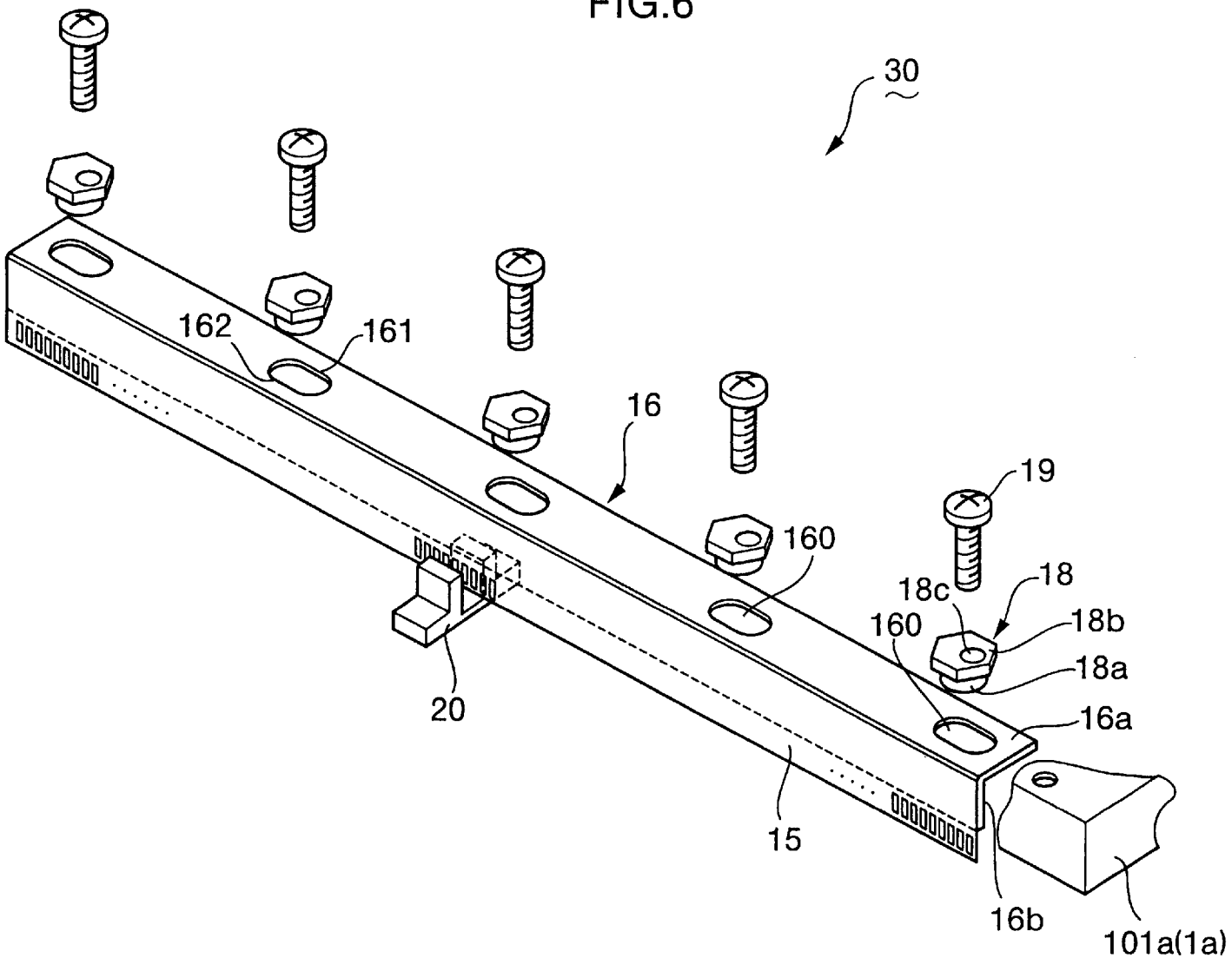
FIG. 6 is a perspective view of an essential part of the position detection device, in which an elongated metal member 16, an adjustment member 18, and screws 19 are not yet assembled together.

The strip-shaped timing fence 15 is provided to extend horizontally, from left to right, above the carriage 10. The timing fence 15 is made from a transparent film printed with a plurality of slits at a uniform interval. As shown in FIGS. 4 through 6, the timing fence 15 is attached to the main body (frame) 1*a* via an elongated metal member (support member) 16.

More specifically, the main body 1*a* has a horizontal support plate 101*a* which extends parallel to the guide bars 11 and 12 and which has an upper and lower surfaces extending horizontally. This support plate 101*a* extends over the entire scanning range of the recording head 7. As shown in FIGS. 3 through 6, the metal member 16 is elongated also in the scanning direction of the recording head 7. The elongated metal member 16 has an L-shaped cross-section, and is attached to the front edge of the support plate 101*a*. As shown in FIG. 6, the elongated metal member 16 is constructed from: a horizontal plate portion 16*a* which extends horizontally; and a vertical plate portion 16*b* which extends downwardly from a front edge of the horizontal plate portion 16*a*. A right angle in formed between the horizontal plate portion 16*a* and the vertical plate portion 16*b*, thereby forming the L-shaped cross-section. As shown In FIG. 6, the elongated metal member 16 is fixed to the support plate 101*a* via a plurality of adjustment members 18 and a plurality of attachment screws 19. Details of the elongated metal member 16, the adjustment members 18, and the attachment screws 19 will be described later.

As shown in FIG. 5, the encoder 20 is constructed from an encoder base portion 200 for mounting thereon a light emitting unit 20*a* and a light receiving unit 20*b*. The encoder base portion 200 is mounted on the carriage 10. The light emitting unit 20*a* and the light receiving unit 20*b* are supported on the encoder base portion 200 as being disposed apart from each other as shown in FIG. 5.

More specifically, the encoder base portion 200 has a pair of support portions 201 and 202, at which the light emitting unit 20*a* and the light receiving unit 20*b* are supported, respectively, so that the light emitting unit 20*a* and the light receiving unit 20*b* confront with each other via a gap therebetween. The encoder 20 is positioned so that the timing fence 15 is sandwiched between the light emitting unit 20*a* and the light receiving unit 20*b*. The encoder 20 moves together with the carriage 10 and the image recording head 7. The encoder 20 therefore counts the slits in the timing fence 15 while the carriage 10 moves horizontally. By counting the slits in the timing fence 15, the encoder 20 can detect the amount of movement by the carriage 10 and, therefore, can determine the present position of the recording head 7.

Thus, the position detecting device 30 is constructed from the encoder 20, the timing fence 15, the elongated metal member 16, the adjustment members 18, and the attachment screws 19. As will be described later, the image forming device 1 is further provided with a control system shown in FIG. 7 for controlling, according to detection signals issued from the encoder 20, the recording head 7, the sheet fending mechanism 39, and the carriage 10.

The positional relationship between the encoder 20 and the timing fence 15 will be described below in greater detail with reference to FIG. 5.

As described above, the encoder 20 includes the light emitting unit 20*a* for emitting light and the light receiving unit 20*b* for receiving the light from the light emitting unit 20*a*. The encoder 20 is positioned so that the light emitting element 20*a* and the light receiving element 20*b* sandwich the timing fence 15 therebetween. The timing fence 15 is made from an elongated transparent film printed with a plurality of slits. The slits are arranged in the timing fence 15 in its elongated direction. The encoder base portion 200 is formed with a depression 20*c* at a position between the light emitting unit 20*a* and the light receiving unit 20*b*. More specifically, the depression 20*c* is formed between the support portions 201 and 202, in which the light emitting unit 20*a* and the light receiving unit 20*b* are supported. The timing fence 15 is located to be received within the depression 20*c* as being sandwiched between the light emitting unit 20*a* and the light receiving unit 20*b*.

With the above-described positional relationship between the encoder 20 and the timing fence 15, the encoder 20 can move parallel to the timing fence 15. The light emitting unit 20*a* in constructed from a single light emitting element, and the light receiving unit 20*b* is constructed from four light receiving elements. The encoder 20 and the timing fence 15 are positioned so that a distance t of about 0.3±0.2 mm is uniformly provided between the timing fence 15 and the light receiving unit 20*b*.

When the distance t becomes larger than 0.3±0.2 mm, light will diffuse after passing through the timing fence 15 and therefore will not fall incident on the light receiving unit 20*b*. The encoder 20 will become incapable of counting the slits accurately. That is, the encoder 20 will perform an error detection operation. On the other hand, when the distance t becomes zero (0) mm, the light receiving unit 20*b* will contact the timing fence 15, which will reduce durability of both the light receiving unit 20*b* and the timing fence 15. Considering the above-described drawbacks, the encoder 20 and the timing fence 15 are positioned so that the distance t between the light receiving unit 20*b* and the timing fence 15 is set to 0.3±0.2 mm.

According to the present embodiment, the elongated metal member 16 is made from aluminum, and the timing fence 15 is made from polyester base material. The aluminum and the polyester base material have almost the same coefficient of linear expansion. Accordingly, the elongated metal member 16 and the timing fence 15 have almost the equal coefficient of linear expansion.

The elongated metal member 16 and the timing fence 15 are attached with each other via adhesive of a type having tackiness or stickiness. That is, a part of one surface of the timing fence 15 is attached to the vertical plate portion 16*b* of the elongated metal member 16 via adhesive of a type having tackiness. For example, the adhesive added with tackiness agent can be used for attaching the timing fence 15 to the metal member 16. The tackiness will permit a minute difference to be generated between the expansion amounts of the elongated metal member 16 and the timing fence 15. More specifically, the adhesive with tackiness will not be completely hardened even after dried. The adhesive therefore presents a certain amount of viscosity even after dried. Accordingly, the tackiness-presenting adhesive can absorb the difference between the expanded amounts of the elongated metal member 16 and the timing fence 15. The tackiness-presenting adhesive will therefore properly eliminate an undesirable effect which will possibly occur due to the slight difference between the coefficients of linear expansion in the elongated metal member 16 and in the timing fence 15. For example, a two-sided tape with its opposite sides being covered with tackiness-presenting adhesive can be used to attach the timing f once 15 to the metal member 16. A representative example of the two-sided tape is a tape named "NITTO TAPE No. 500" (trade name), product by NITTO DENKO Co.

The elongated metal member 16, with its vertical plate 16*b* being thus bonded with the timing fence 15, is attached to the main body 1*a*, an shown in FIG. 6, with using the plurality of adjustment members 18 and the plurality of attachment screws 19.

FIG. 6 shows a disassembled state of the position detection device 30, in which the elongated metal member 16, the adjustment members 18, the attachment screws 19, and the horizontal support plate 101*a* are positioned away from one another.

The horizontal plate portion 16*a* of the elongated metal member 16 is formed with a plurality of elongated through-holes 160 which are arranged at an interval of about 400 mm in the elongated direction of the elongated metal member 16. Each through-hole 160 has a shape elongated along the elongated direction of the elongated metal member 16. Each through-hole 160 has a pair of opposed linear side edges 161 and 162 each extending in the elongated direction of the elongated metal member 16.

Each of the plurality of adjustment members 18 is constructed from a head portion 18*b* and an eccentric collar 18*a* extending downwardly from the head portion 18*b*. The head portion 18*b* is of a hexagonal shape. When adjusting the attached state of the elongated metal member 16 with respect to the frame plate 101*a*, a user can hold the head portion 18*b* with a wrench or the like and rotate the adjustment member 18 around the rotational center thereof, that is, around the center of the hexagonal head portion 18.

The eccentric collar 18*a* is of a hollow cylindrical shape and extends from the head portion 18*b* at a position displaced from the rotational center of the head portion 18*b* by a predetermined eccentric amount in a predetermined direction. A through-hole 18*c* is formed passing through both the head portion 18*b* and the eccentric collar 18*a*. The through-hole 18*c* is for receiving an attachment screw 19.

When attaching the elongated metal member 16 to the support plate 101*a*, the eccentric collar 18*a* of each adjustment member 18 is inserted into a corresponding elongated through-hole 160. The side surface of the eccentric collar lea is contacted with both of the pair of linear side edges 161 and 162 of the through-hole 160. The attachment screw 19 is then inserted through the through-hole 18*c* and is fixedly engaged with the support plate 101*a* (frame 1*a*).

Thus, the elongated metal member 16, bonded with the timing fence 15, is attached to the device frame 1*a* when the eccentric collars 18*a* of all the adjustment members 18 are inserted into the through-holes 160 and then the attachment screws 19 are inserted into the adjustment members 18 and fixedly engaged with the support plate 101*a*.

Even after the elongated metal member 16 is thus attached to the device frame 1*a*, the distance between the encoder 20 and the timing fence 15 can be adjusted in a manner described below.

The user holds the head portion 18*b* of at least one of the adjustment members 18 by a wrench or the like and rotates the head portion 18*b*. As described above, the eccentric collar 18*a* of the adjustment member 18 is contacted with the linear side edges 161 and 162 of the corresponding elongated through-hole 160. Accordingly, when the head portion 18*a* is rotated around its rotational center, the eccentric collar 18*a* eccentrically moves around the rotational center of the head portion 18*b*, thereby urging the elongated metal member 16 via the side edges 161 and 162. The amount of the urging force applied to the elongated metal member 16 corresponds to the amount, with which the eccentric collar 18*a* is displaced from the rotational center of the head portion 18*b*, and the direction, in which the eccentric collar 18*a* is displaced from the rotational center of the head portion 18*b*. As a result, the elongated metal member 16 is urged in a direction almost perpendicular to its elongated direction.

As described above, the elongated metal member 16 is made from aluminum and the elongated through-holes 160 are arranged with the interval of about 400 mm in the lengthwise direction of the elongated through-holes 160. With this structure, even if the elongated metal member 16 is originally bent or curved at some portion, the bent or curved state can be eliminated through applying the urging force to the elongated metal member 16, at the bent portion, by the eccentric collar 18*a*.

Thus, rotating the eccentric collars 18*a* of the adjustment members 18 can finely adjust the attaching position and the bending state of the elongated metal member 16 after the elongated metal member 16 is attached to the main body 1*a*. It is therefore possible to maintain the distance t between the encoder 20 and the timing fence 15 to be uniform over the entire scanning area of the image recording head 7.

As described above, according to the position detection device 30 of the present embodiment, the timing fence 15 is formed with the plurality of slits arranged in its elongated direction. The elongated metal member 16 is provided for supporting the timing fence 15 so that the timing fence 15 will extend in the scanning direction of the image recording head. The encoder 20 is provided for counting the slits on the timing fence 15 while the carriage 10 moves in the scanning direction. The gap between the encoder 20 and the elongated metal member 16. i.e., the timing fence 15 can be adjusted properly and uniformly over the entire scanning area of the carriage 10 through rotating the eccentric collars 18*a* of the adjustment members 18, which are inserted into the elongated through-holes 160 formed in the elongated metal member 16. Thus, the gap between the timing fence 15 and the encoder 20 can be easily adjusted, thereby allowing the position detection device 30 to perform accurate positional detection.

The structure of the control system provided to the image forming device 1 will be described below with reference to FIG. 7.

Figure 7:
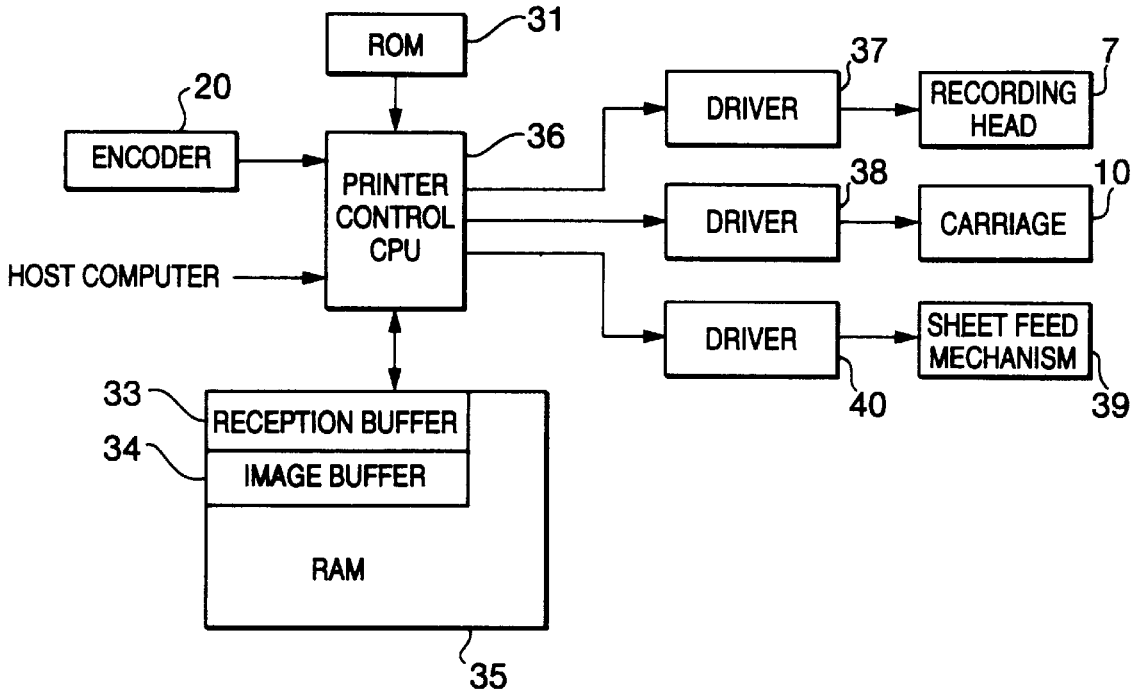
FIG. 7 is a block diagram showing the structure of a control system provided to the image forming device of the first embodiment.

As shown in FIG. 7, the image forming device 1 is provided with a printer control CPU (controller) 36. The CPU 36 is connected with a ROM 31, a RAM 35, and the encoder 20. The RAM 35 is provided with a reception buffer 33 and an image buffer 34 for temporarily storing data received from a host computer (not shown). The ROM 31 is stored with a program for performing a printing operation of FIGS. 8–10 based on the received data. The ROM 31 is also stored with data of patterns such as character fonts. The CPU 36 is also connected with: a driver 37 for driving the recording head 7, the driver 38 for driving the carriage 10; and the driver 40 for driving the sheet feeding mechanism 39. With the above-described structure, the recording head 7, the paper feed mechanism 39, and the carriage 10 are controlled based on detection signals outputted from the encoder 20. That is, while the carriage drive mechanism 38 moves the carriage 10 parallel to the platen 2, the recording head 7 is driven by the driver 37 to elect ink from selected nozzles, thereby recording images on the recording medium P set over the platen 2. When one scan is completed, that is, when the carriage 10 has made one complete left-to-right movement across the recording medium P, the paper feed mechanism 39 feeds the recording medium P forward a prescribed distance, setting the next line on the recording surface in position to be recorded.

The image recording operation conducted by the image forming device 1 of the present embodiment will be described below in greater detail with reference to the flowcharts of FIGS. 8 through 10.

Figure 8:
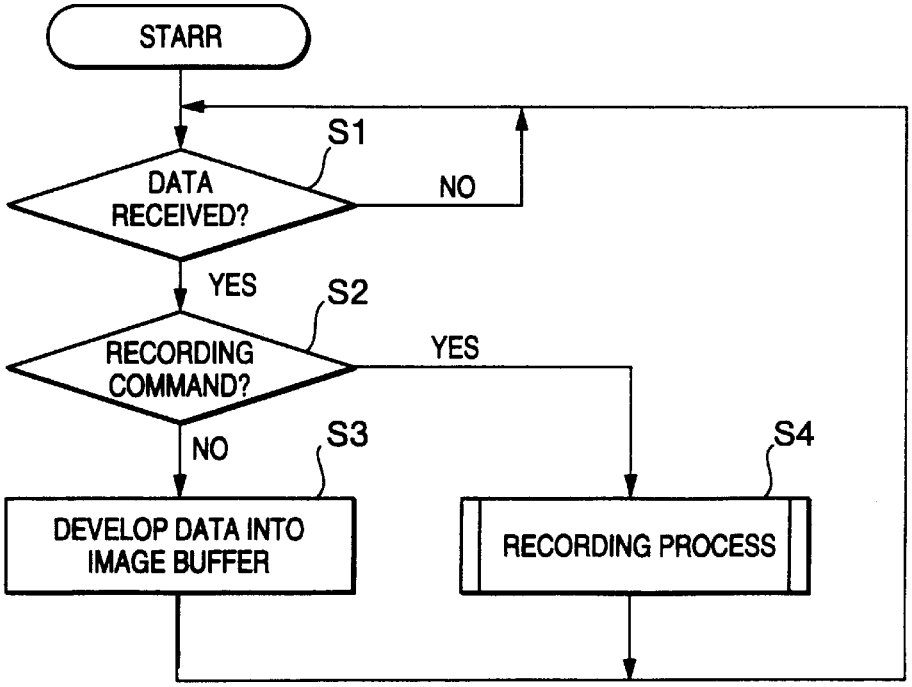
FIG. 8 is a flow chart of a recording process performed by the image forming device.
Figure 9:
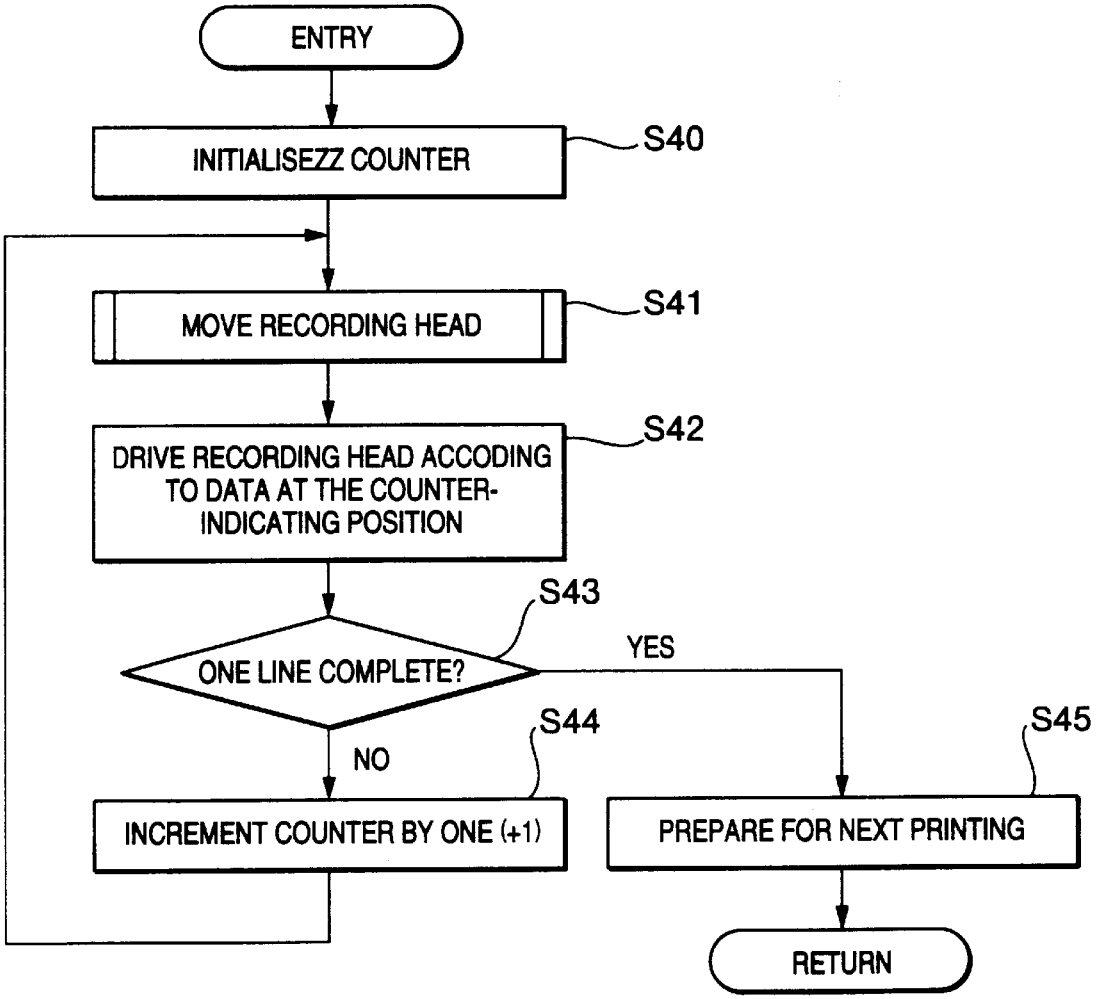
FIG. 9 is a flowchart of a subroutine of a recording process in FIG. 8.

As shown In FIG. 8, when data is received from the host computer (yes in S1), it is judged in S2 whether or not the received data is a recording command. When the received data is not a recording command (no in S2), the received data is developed into the image buffer 34 in S3. The program then returns to S1. When the received data is a recording command (yes in S2), on the other hand, the program proceeds to a subroutine of a recording process in S4.

The recording process (subroutine) of S4 will be described below with reference to FIG. 9.

When the program enters the recording subroutine, a counter for reading data from the image buffer 34 is initialized in S40. Then, in S41, a recording head moving process (subroutine) is executed to move the carriage 10 so that the nozzles of the recording head 7 will confront a position to be recorded. In S42, the recording head 7 is driven according to data stored in the image buffer 34 at a position indicated by the present value of the reading counter. It is then judged in S43 whether or not one-line printing is completed. When one line has not yet been printed (no in S43), the reading counter is incremented by one (1) in S44, and the program returns to S41. The processes from S41 to S44 are repeated until one line is completely printed. When one line has been printed (yes in S43), the image buffer 34 is prepared in S45 to be capable of storing the next line's worth of data at a leading end of each memory area. At this time, the driver 40 drives the sheet feeding mechanism 39 to feed the recording medium P by a predetermined amount of distance to make the next line position on the recording medium P confront the recording head 7. Then, the program returns to the main routine of FIG. 8.

Next, the subroutine of 641 for moving the recording head 7 to the recording position will be described with reference to FIG. 10.

Figure 10:
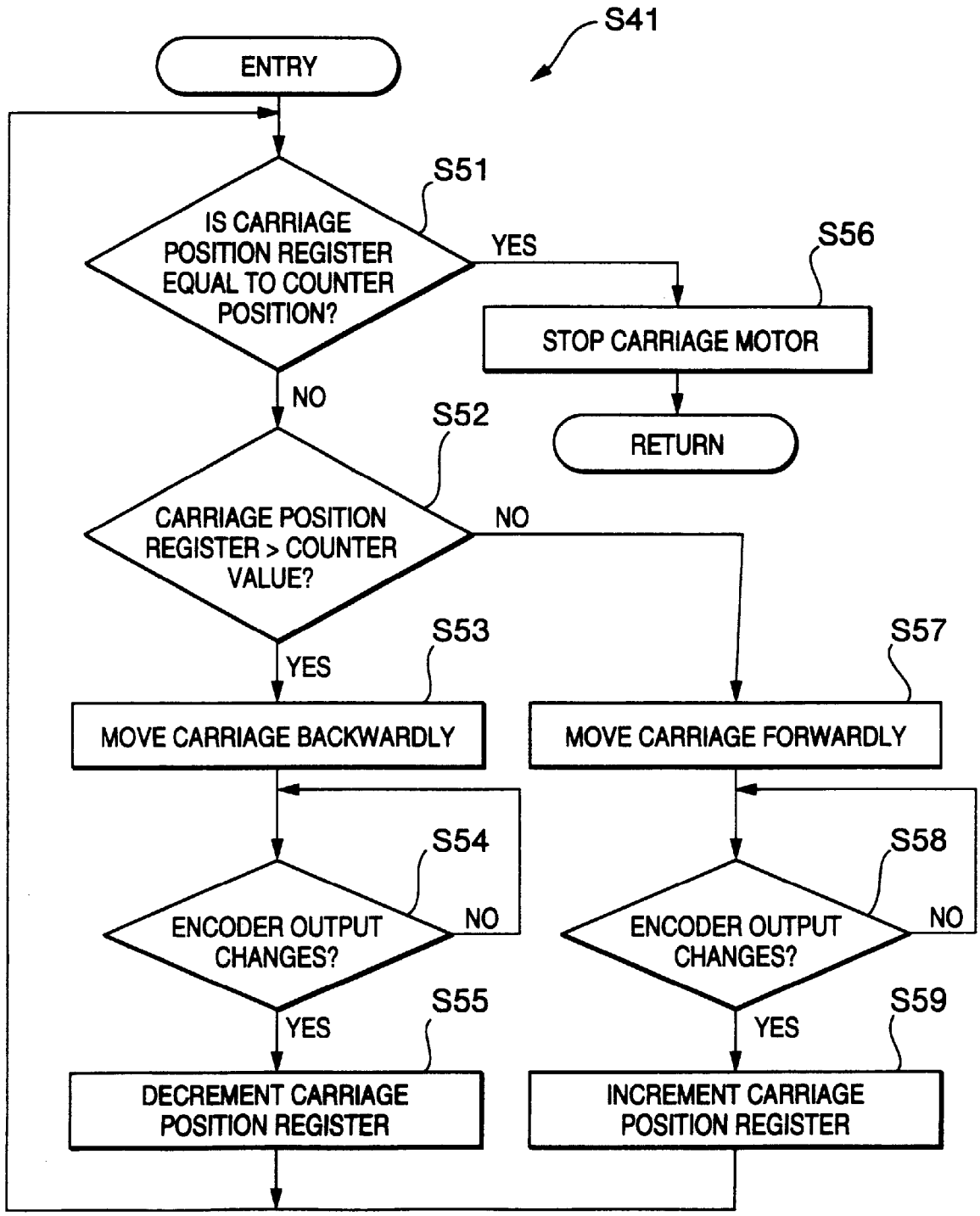
FIG. 10 is a flowchart of a subroutine of a recording head moving process in FIG. 9.

When the program enters the subroutine of FIG. 10, it is first judged in S51 whether or not the present value of a carriage position register is equal to the present counter value. When the carriage position register is equal to the counter value (yes in S51), it is determined that the carriage 10 is already located at a desired recording position. Accordingly, in S56, the carriage motor in the carriage drive mechanism 38 is stopped.

When the carriage position register value is higher than the counter value (No in S51 and Yes in S52), on the other hand, the carriage driver mechanism 38 is controlled in S53 to move the carriage 10 backwardly. When the output from the encoder 10 changes (yes in S54), the carriage position register value is decremented in S55. Then, the program returns to S51.

When the carriage position register value is lower than the counter value (no in S51, no in S52), the carriage driver mechanism 38 is controlled in S57 to move the carriage 10 forwardly. When the output from the encoder 10 changes (yes in S58), the carriage position register value is incremented in S59. Then, the program returns to S51.

Thus, the image forming device 1 can print desired images onto the recording medium P based on positional information of the recording head 7 obtained by the position detection device 30.

A modification of the position detection device 30 according to the first embodiment will be described below with reference to FIG. 11.

Figure 11:
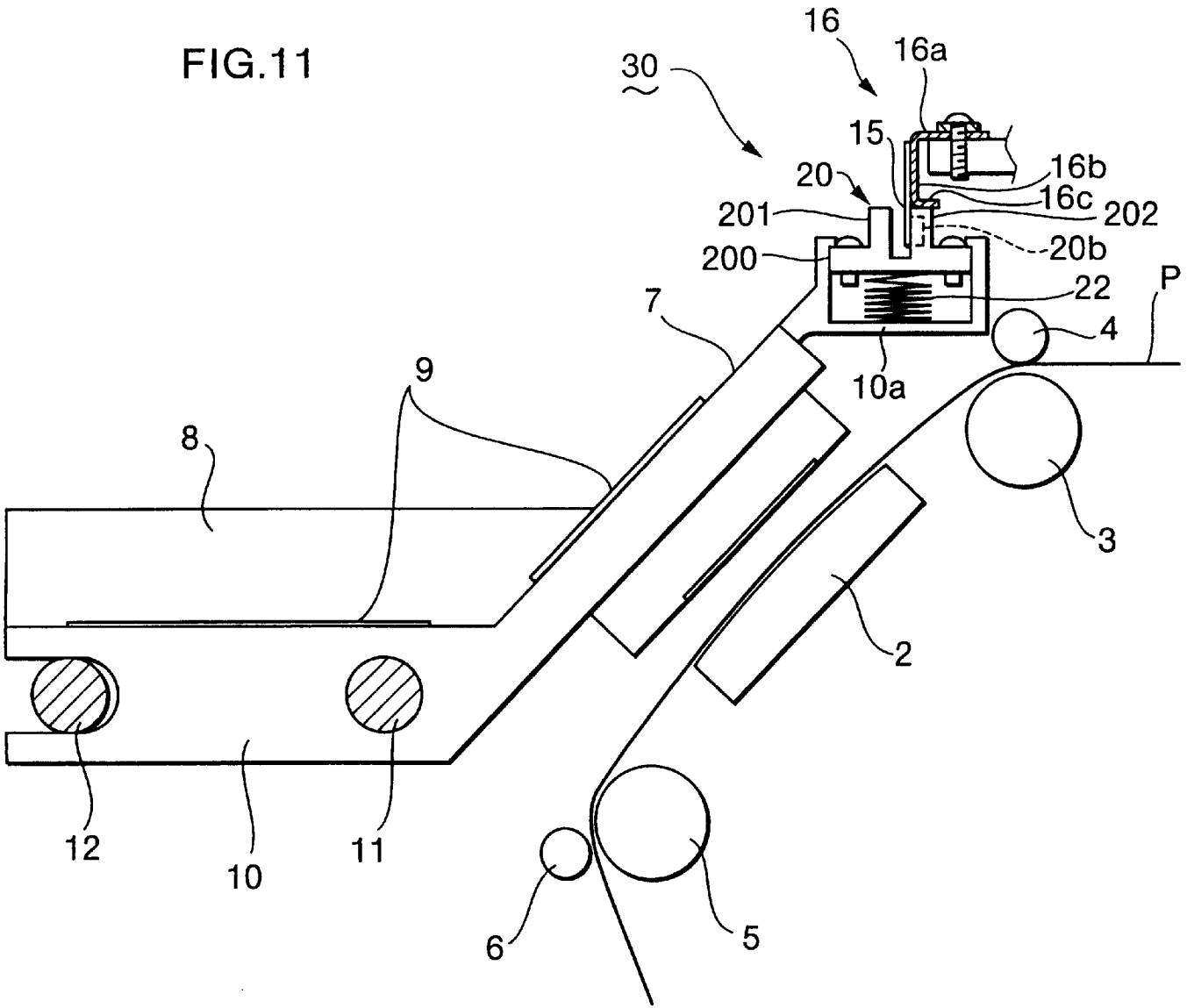
FIG. 11 is a cross-sectional side view of the image recording mechanism, to which a modification of the position detection device of the first embodiment is applied.

FIG. 11 is a cross-sectional side view, corresponding to FIG. 4, of the image recording mechanism employing the position detection device 30 of the present modification. The structure of the position detection device 30 of the present modification is the same as that of the above-described first embodiment except that: the elongated metal member 16 in bent at a lower tip end of the vertical plate portion 16*b* to form a lower horizontal plate portion 16*c*; and that the carriage 10 is designed to have a carriage support portion 10*a* for supporting thereon the encoder 20 via a compression spring 22. Thus, the encoder 20 is mounted to the carriage 10 as being movable upwardly and downwardly.

The position detection device 30 of the present modification is mounted in the image forming device 1 which has the same structure and performs the same operation as described in the first embodiment.

With this structure, when the carriage 10 scanningly moves along the timing fence 15, an upper surface of the supporting portion 202 of the encoder 20, that supports the receiving unit 20*b* therein, pressingly slides against the bottom surface of the lower horizontal plate portion 16*c* of the elongated metal member 16. Accordingly, the positional relationship between the elongated metal member 16 and the encoder 20 is maintained fixed also in the vertical direction over the entire scanning area of the carriage 10. The positional relationship between the timing fence 15 and the encoder 20 is therefore maintained fixed also in the vertical direction in the entire scanning area of the carriage 10. More specifically, the encoder 20 is supported to the carriage 10 in the form of a cantilever. Accordingly, the encoder 20 may possibly swing with respect to the carriage 10 when the carriage 10 scanningly moves along the guide bars 11 and 12. Even in this case, the spring 22 can maintain the encoder 20 to contact with the metal member 16, thereby maintaining fixed the positional relationship between the encoder 20 and the timing fence 15 in the vertical direction. The encoder 20 can therefore detect slits on the timing fence 15 more accurately.

As described above, according to the position detection device 30 of the present embodiment, when one adjustment member 18 is rotated, the eccentric collar 18*a*, which is inserted in the elongated through-hole 160 of the elongated metal member 16, is eccentrically rotated, whereby the position of the elongated metal member 16 attached to the device frame 1*a* is adjusted. Accordingly, even after the elongated metal member 16 is attached to the main body 1*a*, the amount of the gap between the encoder 20 and the elongated metal member 16 can be adjusted. The plurality of adjustment members 18 are provided as arranged along the scanning direction of the carriage 10. It is therefore possible to attach the elongated metal member 16 to the frame 1*a* so that the elongated metal member 16 extends sufficiently linearly over the entire length of the scanning areas it is therefore possible to maintain the distance between the encoder 20 and the slit member 15 properly and uniformly over the entire scanning area of the recording head 7. It is ensured that the encoder will not perform any error detection and will perform an accurate detection operation.

The elongated metal member 16 and the slit member 15 are made from material having almost the same coefficient of linear expansion. Difference between the lengths of the elongated metal member 16 and the slit member 15, which will possibly occur due to some temperature change, can be made small. Additionally, the elongated metal member 16 and the slit member 15 are attached with each other via a tackiness-presenting adhesive material. Any temperature-induced slight difference between the lengths of the elongated metal member 16 and the slit member 15 can be permitted by the tackiness-presenting adhesive material. It is noted that if the elongated metal member 16 and the slit member 15 are completely attached with each other, the elongated metal member 16 and the slit member 15 will be bent like a bimetal even due to any slight differences between their coefficients of linear expansion. However, using the tackiness-presenting adhesive material can eliminate such a disadvantage.

Especially, according to the position detection device 30 of the modification, the light-receiving unit supporting portion 202 of the encoder 20 pressingly slides against the lower horizontal plate portion 16*c* of the elongated metal member 16 when the carriage 10 scanningly moves parallel to the timing fence 15. With this arrangement, the positional relationship between the elongated metal member 16 and the encoder 20 is maintained fixed also in the vertical direction. The positional relationship between the slit member 15 and the encoder 20 can therefore be maintained accurately uniformly over the entire scanning area. Position detection can be performed with high accuracy.

Figure 12:
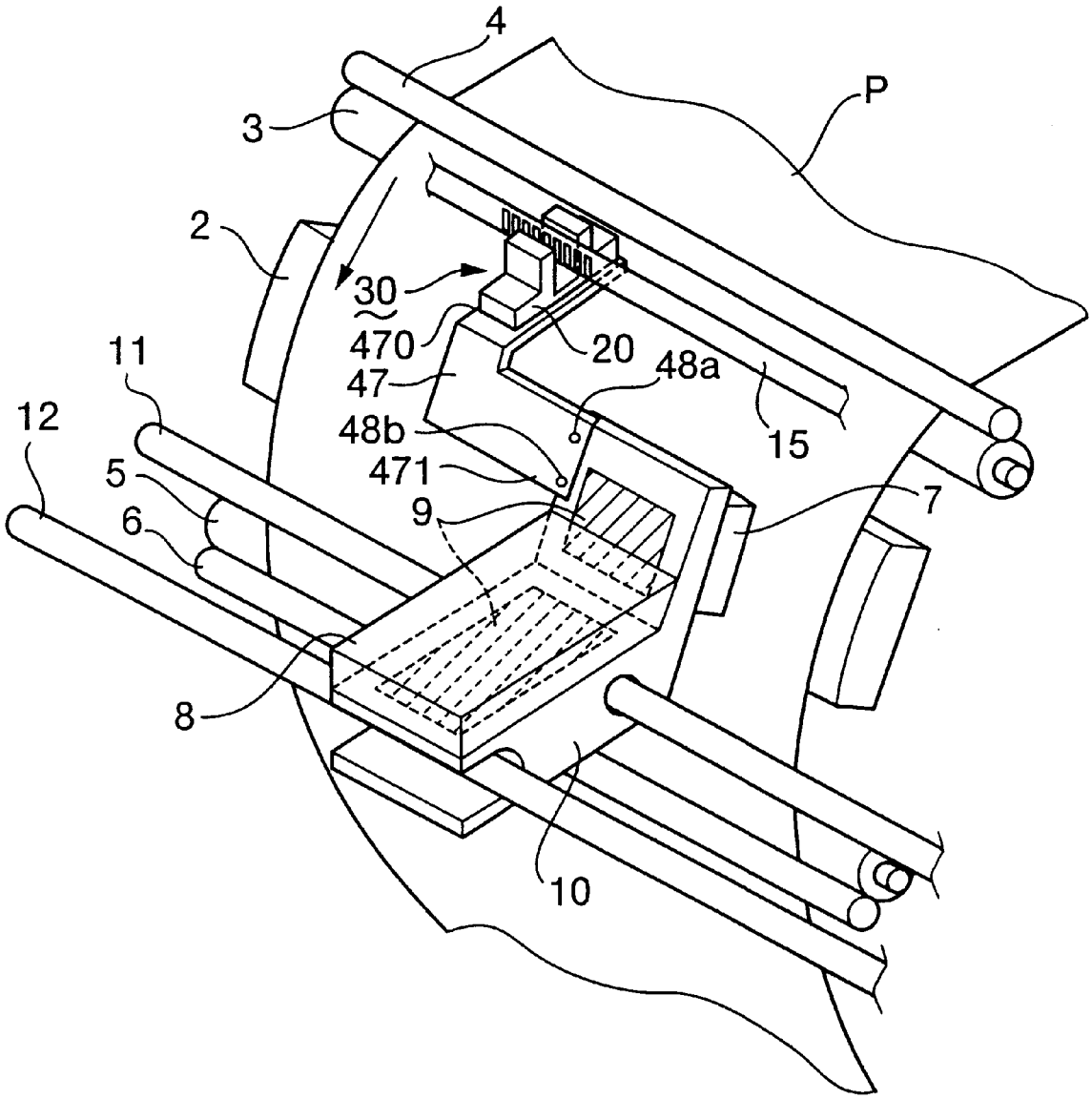
FIG. 12 is a perspective view of an image recording mechanism, to which applied is a position detection device of a second embodiment.

A second embodiment of the position detection device 30 of the present invention will be described below with reference to FIG. 12.

The position detection device 30 of the present embodiment is the same an that of the first embodiment except that the encoder 20 is not directly mounted to the carriage 10. That is, the encoder 20 is mounted on the carriage 10 via an arm portion 47 as shown in FIG. 12.

It is noted that also in the present embodiment, the timing fence 15 is supported via the metal member 16 on the horizontal support plate 101*a* of the image forming device 1 in the same manner as in the first embodiment. However, the metal member 16 and the horizontal support plate 101*a* are omitted from the drawing of FIG. 12 for simplicity and clarity.

According to the present embodiment, the arm portion 47 supports the encoder 20 while providing a predetermined amount of distance between the encoder 20 and the carriage 10 in order to prevent the encoder 20 from being heated by the heaters 9. That is, the encoder 20 is attached to a tip end 470 of the arm portion 47, while the arm portion 47 is attached to the carriage 10 at its base portion 471 with a pair of pins 48*a* and 48*b*. The base portion 471 is opposite to the tip end 470, and is apart from the tip end 470 by the entire length of the arm portion 47.

Thus, the arm portion 47 locates the encoder 20 away from the heaters 9. The encoder 20 will not be affected by heat generated at the heaters 9. The encoder 20 will not be heated by heat generated at the heaters 9. The encoder 20 will therefore not transmit heat to the timing fence 15. The timing fence 15 will therefore not be thermally expanded or bent. The encoder 20 will not perform any undesirable error detection operations due to heat generated at the heaters 9.

In the above description, the arm portion 47 is designed to have the predetermined amount of length to locate the encoder 20 away from the carriage 10. However, it may be preferable to additionally provide a thermal insulation material between the arm 47 and the carriage 10 and/or between the arm 47 and the encoder 20.

It may also be preferable to form the arm portion 47 from thermal insulation material. Thus using the thermal insulation material together with the structure of the arm portion 47 can more reliably insulate heat, rather than using the structure of the arm portion 47 alone. It is as therefore possible to more reliably shut off heat transmission from the heaters 9 toward the encoder 20 and toward the timing fence 15.

Figure 13:
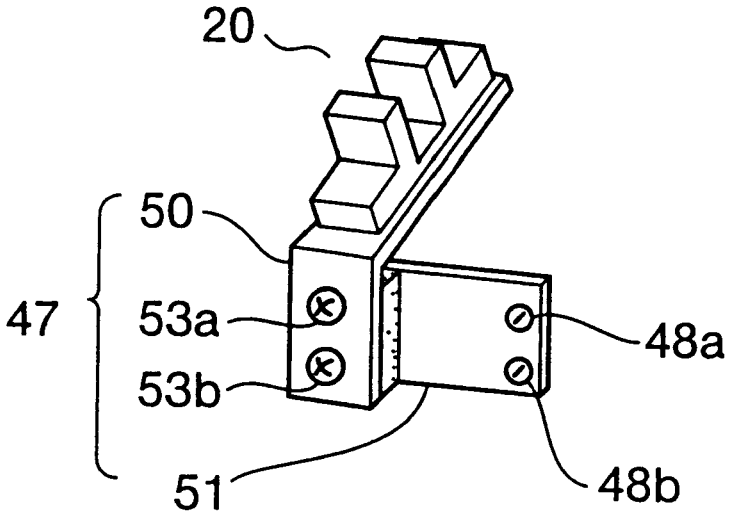
FIG. 13(*a*) is a perspective view of an arm portion supporting an encoder thereon according to a modification of the second embodiment.
Figure 13:
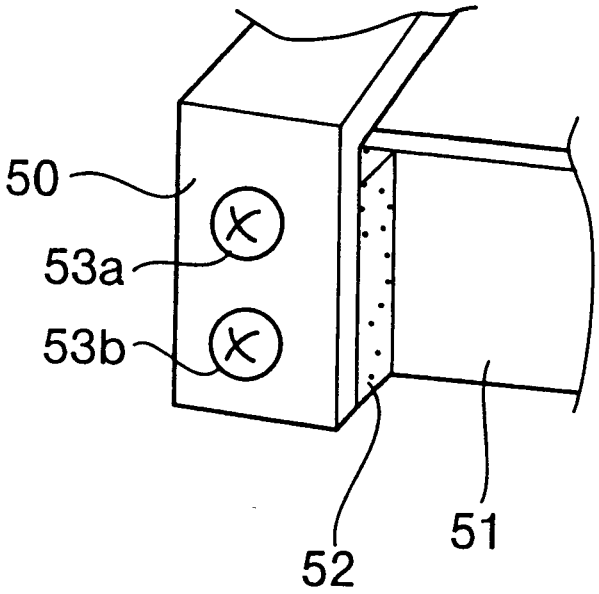

According to a modification of the present embodiment, the encoder 20 may be attached to the carriage 10 via a thermal insulation structure shown in FIG. 13(*a*). In order to provide this thermal insulation structure, the arm portion 47 is divided into two portions 50 and 51. The encoder 20 is attached to the portion 50. The other portion 51 is attached to the carriage 10 via the pine 48*a* and 48*b* in the same manner as the arm portion 47 in FIG. 12. As shown in FIG. 13(*b*), the portions 50 and 51 are connected to each other via a pair of pins 53*a* and 53*b* with a thermal insulation material 52 being sandwiched between the portions 50 and 51. Representative examples of the thermal insulation material 52 include ceramic and mica. Thermal transmission from the portion 51 to the portion 50 can be prevented by the thermal insulation material 52.

The above-described position detection device 30 is mounted in the image forming device 1 which has the same structure and performs the same operation as described in the first embodiment.

As described above, according to the second embodiment, the arm portion 47 locates the encoder 20 at a predetermined amount of distance away from the carriage 10. The encoder 20 is therefore not affected by heat generated at the heaters 9 mounted on the carriage 10. Heat generated at the heaters 9 is not transmitted to the timing fence 15 via the encoder 20. The timing fence 15 will not thermally expand or bend. No undesirable effects will be provided to the position detection operation due to heat generated at the heaters 9. The position detection device 30 can perform an accurate position detection operation.

As described above, according to the first embodiment of the present invention, the position detection device 30 includes the slit member 15 which is elongated and which is formed with the plurality of slits in the elongated direction. The elongated supporting member 16 is attached to the horizontal support plate 101*a* of the image forming device 1 for supporting the slit member 15 thereon so that the slit member 15 extends in the scanning direction of the image recording head 7. The encoder 20 is mounted on the carriage 10. The carriage 10 mounts thereon the image recording head 7. The encoder 20 is for counting the slits formed on the slit member 15 as the carriage 10 moves. The adjustment mechanism is provided for adjusting the position, at which the supporting member 16 is attached to the frame 101*a* of the image forming device 1.

With the above-described structure, it is possible to adjust the position where the support member 16 is attached to the horizontal support plate 101*a*. It may possibly be found that the distance between the encoder 20 and the slit member 15 is not uniform over the entire scanning area of the recording head 7, after the alit member 15, the support member 16, and the encoder 20 are mounted to the image forming device 1. Even in this cases the position where the supporting member 16 is attached to the image forming device frame 101*a* can be freely adjusted so that the distance between the encoder 20 and the slit member 15 will become properly uniform over the entire scanning area. The position detection device 30 will therefore not perform any error detection, and therefore will perform an accurate positional detection.

It is noted that the supporting member 16 is formed with the plurality of elongated through-holes 160. According to the adjustment mechanism, the eccentric collar 18*a* is provided for being received in a corresponding elongated through-hole 160. The eccentric collar 18*a* is displaced by a predetermined eccentric amount from its rotational center. The attachment screw 19 is provided for being inserted through a through-hole 18*c* provided through the eccentric color 18*a* and for being engaged with the frame 101*a* of the image forming device 1. With this arrangement, the size of the gap between the encoder 20 and the supporting member 16 can be easily adjusted through merely rotating the eccentric collar 18*a* around its rotational center.

Especially, according to the modification of the first embodiment, the carriage 10 supports thereon the encoder 20 so that a part of the encoder 20 pressingly slides against an end surface of the supporting member 16 when the carriage 10 scanningly moves. In this case, the distance between the supporting member 16 and the encoder 20 can be maintained uniform over the scanning area of the recording head more accurately. Accordingly, the distance between the supporting member 16 and the encoder 20 can be maintained uniform more accurately.

The support member 16 and the slit member 15 are made from materials having almost the same coefficients of linear expansion. The support member 16 and the slit member 15 are attached with each other via the tackiness-presenting adhesive. With this arrangement, even when the support member 16 and the slit member 15 expand due to temperature changes, the difference between the expanded lengths thereof can be made small. The difference can further be absorbed by the tackiness-presenting adhesive material. Accordingly, even when the temperature changes, the support member 16 or the slit member 15 will not be bent. That is, when the slit member 15 and the support member 16 are attached completely to each other, they will be bent as a bimetal fashion if there exists a slight difference between their coefficients of linear expansion. Contrarily, according to the above-described embodiments, the slit member 15 and the support member 16 are attached to each other via the tackiness-presenting adhesive. The tackiness will permit a difference between the coefficients of linear expansion of them. It is possible to maintain that the slit member 15 extend sufficiently linearly. The position detection device 30 can attain an accurate positional detection.

The slit member 15 is constructed from a film printed with slits. Fine and accurate slits can therefore be formed on the slit member 15. The encoder 20 is constructed from the light emitting unit 20*a* for emitting light and the light receiving unit 20*b* for receiving the light emitted from the light emitting unit 20*a*. The encoder 20 is located relative to the slit member 15 so that the light emitting unit 20*a* and the light receiving unit 20*b* sandwiching the film 15 therebetween. With this arrangement, the encoder 20 can perform high accurate positional detection of the image recording head 7.

Especially, according to the second embodiment, the image recording head 7 and the heaters 9 for thermally melting the solid state image recording ink are both mounted on the carriage 10. The encoder 20 is attached to the carriage 10 at a position that receives no effects from the heaters 9. The encoder 20 will not be heated by heat generated at the heaters 9. The heat will therefore not be transmitted from the encoder 20 to the slit member 15. The slit member 15 will not be thermally expanded or bent. The temperature of the encoder 20 will not exceed the rated temperature of the encoder 20. It is therefore possible to prevent the encoder 20 from performing error detection operation.

The encoder 20 is attached to the carriage 10 via the arm portion 47 which provides the predetermined amount of distance between the encoder 20 and the heaters 9 and the image recording head 7. Heat will not be transmitted from the heaters 9 and the image recording head 7 via the arm member 47 toward the encoder 20.

In the modification, the encoder 20 and the carriage 10 are engaged with each other via the member having the thermal insulation structure. It in possible to more reliably prevent heat generated at the heaters 9 from being transmitted to the encoder 20, and accordingly to the slit member 15.

The slit member 15 is constructed from a film printed with slits. Thus, the alit member is formed with fine and accurate slits, which can attain high accurate position detection operation. Though the film Is likely to be thermally expanded, the above-described arrangement can efficiently provide a thermal insulation to the film from generated heat. That is, heat generated at the heater 9 will not be transmitted to the slit member 15 via the encoder 20. This ensures high accurate position detection operation.

While the invention has been described in detail with reference to the specific embodiments thereof, it would be apparent to those skilled in the art that various changes and modifications may be made therein without departing from the spirit of the invention.

For example, in the above-described embodiments, the position where the elongated metal member 16 is attached to the frame 1*a* is adjusted through rotating the adjustment members 18 and rotating the eccentric collars 18*a* accordingly. However, other various methods can be employed to adjust the position where the elongated metal member 16 is attached to the device body frame 1*a*.

In the above description, hot melt ink is used in the recording head 7. However, it is also possible to use other types of ink such as an ink in liquid form even at room temperature.

In the second embodiment, the slit member 15 is supported on the frame body 1*a* via the elongated metal member 16 as in the first embodiment. However, the slit member 15 may be supported to the frame body 1*a* via other various methods.

What is claimed is:

1. An image recording device for recording an image, the device comprising:

a frame body;

an image recording medium feed unit fixedly secured to the frame body for feeding an image recording medium in a recording medium feeding direction;

a recording head capable of recording an image onto the image recording medium fed by the image recording medium feed unit;

a carriage provided movable with respect to the frame body, the carriage mounting thereon the recording head and scanning the recording head in a scanning direction relative to the image recording medium fed by the image recording medium feed unit, the scanning direction being different from the recording medium feeding direction;

a supporting member attached to the frame body and elongated in the scanning direction;

an elongated slit member attached to the supporting member so that the slit member is elongated in the scanning direction, the slit member being formed with a plurality of slits arranged in the scanning direction;

an encoder, mounted on the carriage, for counting the slits formed on the slit member while the carriage moves in the scanning direction; and an adjustment unit for adjusting a position, at which the supporting member is attached to the frame body, thereby adjusting an amount of a gap provided between the encoder and the slit member.

2. An image recording device as claimed in claim 1, wherein the adjustment unit includes a first urging unit for urging the supporting member relative to the frame body in a first direction normal to the scanning direction, thereby adjusting the amount of the gap provided between the encoder and the slit member.

3. An image recording device as claimed in claim 2, wherein the supporting member is formed with an elongated through-hole elongated in the scanning direction, and wherein the first urging unit includes:

an adjustment member eccentrically rotatable around a predetermined rotational center, the adjustment member being received in the elongated through-hole; and an attachment member for attaching both the adjustment member and the supporting member to the frame body while permitting the adjustment member to rotate around the predetermined rotational center relative to the frame body while moving the supporting member in the first direction, thereby adjusting the position, at which the supporting member is attached to the frame body, in the first direction.

4. An image recording device as claimed in claim 3, wherein the supporting member includes a pair of opposite side edges defining the elongated through-hole therebetween in the first direction, each of the opposite side edges extending linearly in the scanning direction, wherein the adjustment member includes:

a rotational head portion rotatable around its rotational center; and an eccentric collar portion provided extending from rotational head at a position displaced from the predetermined rotational center of the rotational head, the eccentric collar portion eccentrically rotating about the predetermined rotational center when the rotational head rotates, a through-hole being formed through the rotational head and the eccentric collar, the eccentric collar being received in the elongated through-hole and contacting with the pair of opposite side edges of the elongated through-hole, and wherein the attachment member includes a screw for being inserted through the through-hole formed through the rotational head and the eccentric collar which is inserted through the elongated through-hole, thereby attaching both the adjustment member and the supporting member to the frame body while permitting the eccentric collar portion to eccentrically rotate around the predetermined rotational center relative to the frame body while urging the supporting member in the first direction via the opposite side edges.

5. An image recording device as claimed in claim 2, wherein the adjustment unit further includes a second urging unit for urging the supporting member relative to the frame in a second direction substantially normal to both the first direction and the scanning direction, thereby adjusting a positional relationship between the encoder and the slit member in the second direction.

6. An image recording device as claimed in claim 5, wherein the carriage includes an urging member for supporting the encoder with an urging force in the second direction toward the supporting member, a part of the encoder sliding pressingly against a part of the supporting member while the carriage moves in the scanning direction.

7. An image recording device as claimed in claim 1, wherein the supporting member and the slit member are made from material having almost the same coefficients of linear expansion, the slit member being attached to the supporting member via adhesive having tackiness.

8. An image recording device as claimed in claim 7, wherein the slit member is made from a film printed with the plurality of slits, and wherein the encoder is constructed from a light emitting unit for emitting light and a light receiving unit for receiving the light emitted from the light emitting unit, the light emitting unit and the light receiving unit sandwiching the film therebetween.

9. An image recording device as claimed in claim 1, wherein the image recording head includes an ink ejection head for ejecting ink onto the image recording medium, and wherein the carriage includes:

a head supporting portion for supporting thereon the ink ejection head and a heater for heating the ink; and an encoder supporting portion for supporting the encoder at a position apart from the head supporting portion.

10. An image recording device as claimed in claim 9, wherein the encoder supporting portion is connected to the head supporting portion via an arm portion having a predetermined length.

11. An image recording device as claimed in claim 9, wherein the encoder supporting portion is connected to the head supporting portion via a thermal insulation portion having a predetermined thermal insulation structure.

12. An image recording device as claimed in claim 9, wherein the slit member is made from a film printed with the plurality of slits, and wherein the encoder is constructed from a light emitting unit for emitting light and a light receiving unit for receiving the light emitted from the light emitting unit, the light emitting unit and the light receiving unit sandwiching the film therebetween.

13. An image recording device for recording an image on an image recording medium, the device comprising:

an image recording medium feeding unit for feeding an image recording medium in a recording medium feeding direction;

a slit member provided extending in a predetermined direction different from the recording medium feeding direction and formed with a plurality of slits arranged in the predetermined direction; and a carriage movable parallel to the slit member in the predetermined direction, the carriage mounting thereon an image recording head for ejecting ink onto the image recording medium and a heater for heating the ink, and an encoder for counting the slits on the slit member mounted on a heat transmission prevention member that is between the encoder and the carriage for preventing heat from being transmitted from the heater to the encoder.

14. An image recording device as claimed in claim 13, wherein the carriage includes a carriage base portion for mounting thereon the heater and the ink ejection head, the heat transmission prevention member including an arm portion, extended from the carriage base portion by a predetermined length, for mounting thereon the encoder.

15. An image recording device as claimed in claim 14, wherein the arm portion includes:

a first arm portion attached to the encoder;

a second arm portion connected to the carriage base portion; and a thermal insulation member made of thermal insulation material and provided between the first arm portion and the second arm portion.

16. An image recording device as claimed in claim 13, wherein the carriage includes a carriage base portion for mounting thereon the heater and the ink ejection head, the heat transmission prevention member including a thermal insulation portion, attached to the carriage base portion, for mounting thereon the encoder, the thermal insulation portion including a thermal insulation structure for preventing heat from being transmitted from the heater to the encoder.

17. An image recording device as claimed in claim 13, wherein the slit member is formed from a film printed with the plurality of slits, and wherein the encoder is constructed from a light emitting unit for emitting light and a light receiving unit for receiving the light emitted from the light emitting unit, the light emitting unit and the light receiving unit sandwiching the film therebetween.

18. A position detection device for detecting a position of an image recording head for recording an image on an image recording medium, the position detection device comprising:

a frame body;

an elongated supporting member attached to the frame body and elongated in a predetermined direction;

a slit member supported by the elongated supporting member, the slit member being elongated in the predetermined direction and being formed with a plurality of slits arranged in the predetermined direction;

an adjustment unit for adjusting the position, at which the supporting member is attached to the frame body; and an encoder, mounted on a carriage which mounts thereon an image recording head, for counting the plurality of slits formed on the slit member while the carriage moves in a direction parallel to the predetermined direction.

19. A position detection device as claimed in claim 18, further comprising the carriage for mounting both the encoder and the image recording head and for moving in the predetermined direction.

20. A position detection device as claimed in claim 19, wherein the carriage moves in the predetermined direction over a predetermined scanning area, the carriage including an encoder supporting portion for pressingly supporting the encoder against the supporting member, a part of the encoder pressingly sliding against an end surface of the supporting member while the carriage moves over the entire scanning area, thereby maintaining a positional relationship between the supporting member and the encoder fixed over the scanning area.

21. A position detection device as claimed in claim 19, wherein the image recording head includes an ink ejection head for ejecting ink, and wherein the carriage includes:

a head supporting portion for supporting the image recording head and a heater for heating the ink; and an encoder supporting portion for supporting the encoder while preventing heat from being transmitted from the heater to the encoder.

22. A position detection device as claimed in claim 21, wherein the encoder supporting portion includes an arm portion for providing a predetermined amount of distance between the encoder and the heater and the image recording head.

23. A position detection device as claimed in claim 21, wherein the encoder supporting portion includes a thermal insulation portion having a thermal insulation structure.

24. A position detection device as claimed in claim 21, wherein the slit member is constructed from a film printed with slits, and wherein the encoder is constructed from a light emitting unit for emitting light and a light receiving unit for receiving the light emitted from the light emitting unit, the light emitting unit and the light receiving unit sandwiching the film therebetween.

25. A position detection device as claimed in claim 18, wherein the supporting member is formed with an elongated through-hole, and wherein the adjustment unit includes:

an eccentric collar for being received in the elongated through-hole and being displaced by a predetermined eccentric amount from its rotational center; and an attachment screw inserted through a through-hole provided in the eccentric color and being engaged with the frame body, the size of a gap between the encoder and the supporting member being adjustable through rotating the eccentric collar.

26. A position detection device as claimed in claim 25, wherein the elongated through-hole is elongated in the predetermined direction.

27. A position detection device as claimed in claim 26, wherein the elongated through-hole has a pair of linear side edges extending in the predetermined direction, the pair of linear side edges being contacted with a side surface of the eccentric collar when the eccentric collar is inserted in the elongated through-hole, the eccentric collar urging the supporting member at the pair of linear side edges when the eccentric collar is eccentrically rotated about the rotational center.

28. A position detection device as claimed in claim 27, wherein the supporting member is formed with a plurality of elongated through-holes which are arranged in the predetermined direction at a predetermined interval.

29. A position detection device as claimed in claim 28, wherein the adjustment unit further includes a rotational head for supporting the eccentric collar, the rotational head being rotatable about its rotational center, the eccentric collar being connected to the rotational head at a position displaced from the rotational center, the size of the gap between the encoder and the supporting member being adjustable through rotating the rotational head about the rotational center.

30. A position detection device as claimed in claim 18, wherein the supporting member and the slit member have almost the same coefficient of linear expansion, and the supporting member and the slit member are attached with each other via adhesive having tackiness.

31. A position detection device as claimed in claim 18, wherein the slit member is constructed from a film printed with slits, and wherein the encoder is constructed from a light emitting unit for emitting light and a light receiving unit for receiving the light emitted from the light emitting unit, the light emitting unit and the light receiving unit sandwiching the film therebetween.

32. A position detection device for detecting a position of an image recording head for recording an image on an image recording medium, the position detection device comprising:

an elongated slit member elongated in a predetermined direction and being formed with a plurality of slits arranged in the predetermined direction;

a carriage provided movable relative to the elongated slit member in the predetermined direction, the carriage including:

a head supporting portion for supporting thereon an ink ejection head for ejecting ink and a heater for heating the ink to be ejected by the ink ejection head;

an encoder supporting portion for supporting thereon an encoder for counting the plurality of slits formed on the slit member while the carriage moves in the predetermined direction; and a heat transmission prevention portion between the encoder and the carriage for preventing heat from being transmitted from the heater to the encoder.

33. A position detection device as claimed in claim 32, wherein the heat transmission prevention portion includes an arm portion for providing a predetermined amount of distance between the encoder and the heater and the image recording head.

34. A position detection device as claimed in claim 33, wherein the arm portion includes:

a first arm portion connected to the encoder supporting portion;

a second arm portion connected to the head supporting portion; and a thermal insulation member made of thermal insulation material and provided between the first arm portion and the second arm portion.

35. A position detection device as claimed in claim 32, wherein the heat transmission prevention portion includes a thermal insulation portion having a thermal insulation structure.

36. A position detection device as claimed in claim 32, wherein the slit member is constructed from a film printed with slits, and wherein the encoder is constructed from a light emitting unit for emitting light and a light receiving unit for receiving the light emitted from the light emitting unit, the light emitting unit and the light receiving unit sandwiching the film therebetween.

* * * * *